US005909828A

United States Patent [19]

Salisbury

[11] Patent Number: 5,909,828

[45] **Date of Patent: *Jun. 8, 1999**

[54] COMPRESSIBLE TUBE DISPENSER WITH ADJUSTABLE ACTUATING LEVER

[75] Inventor: Richard Salisbury, San Clemente, Calif.

[73] Assignee: Source 1 Ergonomics, Inc., Santa Clara, Calif.

[21] Appl. No.: 09/081,478

[22] Filed: May 19, 1998

Related U.S. Application Data

[60] Provisional application No. 60/047,060, May 19, 1997.

[51] Int. Cl.[6] ..... B65D 35/28

[52] U.S. Cl. ..... 222/103; 222/105; 222/214; 222/309

[58] Field of Search ..... 222/43, 95, 105, 222/103, 183, 214, 309, 325–327

[56] References Cited

U.S. PATENT DOCUMENTS

| | | | |
|---|---|---|---|
| 579,135 | 3/1897 | Cooper . | |
| 1,558,195 | 10/1925 | McEnaney | 222/103 |
| 1,600,095 | 9/1926 | Casaclang . | |
| 1,775,400 | 9/1930 | Kramer . | |
| 2,517,796 | 8/1950 | Mathis . | |
| 2,607,513 | 8/1952 | Lawson | 222/214 X |
| 2,644,613 | 7/1953 | Pepin . | |
| 4,581,021 | 4/1986 | Landau et al. | 222/103 X |
| 4,599,625 | 7/1986 | Terasawa et al. | 222/103 X |
| 4,634,023 | 1/1987 | Tanaka et al. . | |
| 4,958,748 | 9/1990 | Otake . | |
| 5,226,562 | 7/1993 | Kirk . | |

*Primary Examiner*—Kevin P. Shaver
*Attorney, Agent, or Firm*—Blodgett & Blodgett, P.C.

[57] ABSTRACT

A liquid dispenser which includes a housing having a chamber for holding a collapsible tube of liquid, a front opening to the chamber, and a side opening to the chamber. An actuating lever is pivotally connected to the housing and has a protrusion extending into the side chamber through the side opening for engaging and compressing the tube. The tube has a dispensing nozzle which extends through the front opening of the housing. A stop mechanism limits the movement of the actuating lever toward the tube for limiting the compression of the tube and the amount liquid dispensed from the tube. More specifically, the stop mechanism is adjustable and the dispenser is fabricated from a plurality of modules.

12 Claims, 5 Drawing Sheets

COMPRESSIBLE TUBE DISPENSER WITH ADJUSTABLE ACTUATING LEVER

CROSS-REFERENCE TO RELATED APPLICATIONS

This application claims the benefit under 35 U.S.C. §119 (e) of prior U.S. Provisional Application No. 60/047,060 filed May 19, 1997; which is hereby incorporated by reference.

STATEMENT REGARDING FEDERALLY SPONSORED RESEARCH OR DEVELOPMENT

This invention has been created without the sponsorship or funding of any federally sponsored research or development program.

BACKGROUND OF THE INVENTION

The present invention is directed to an apparatus for holding a tube of liquid and for dispensing the liquid from the tube. Many liquids such as oils, paints, greases, solder, paste, adhesive, glues, and lubricants are sold in compressible or collapsible tubes. The liquid is dispensed from a tube by compressing the tube.

The principle objection to dispensing liquid from a collapsible tube is that it is difficult to control the amount of liquid being dispensed with any degree of precision. Another objection is that it is difficult to apply the liquid to small or hard to reach places. These and other difficulties experienced with the use of liquid dispensing tubes have been obviated by the present invention.

It is, therefore, a principal object of the invention to provide an apparatus for holding a collapsible tube of liquid and for dispensing the liquid from the tube in a precise controlled manner.

A further object of the present invention is to provide a dispenser for liquid in a collapsible tube which is adaptable for different types of liquids having different viscosities.

Another object of the invention is the provision of an apparatus for dispensing liquid from a collapsible tube wherein the apparatus is adjustable for selectively controlling the degree of compression of the tube to control the amount of fluid dispensed from the tube at each compression.

A still further object of the invention is the provision of an apparatus for holding a collapsible tube of liquid and for dispensing the liquid from the tube for a wide range of applications such as arts and crafts, fingernail cosmetics, dental, medical and many industrial settings.

Another object of the invention is the provision of an apparatus for holding a collapsible tube of liquid and for dispensing the liquid from the tube wherein the apparatus is made of a modular construction in which the modules are simple in construction, easy to assemble and easy to use.

With these and other objects in view, as will be apparent to those skilled in the art, the invention resides in the combination of parts set forth in the specification and covered by the claims appended hereto.

BRIEF SUMMARY OF THE INVENTION

A liquid dispenser which includes a housing having a chamber for holding a collapsible tube of liquid, a front opening to the chamber, and a side opening to the chamber. An actuating lever is pivotally connected to the housing and has a protrusion extending into the side chamber through the side opening for engaging and compressing the tube. The tube has a dispensing nozzle which extends through the front opening of the housing. A stop mechanism limits the movement of the actuating lever toward the tube for limiting the compression of the tube and the amount liquid dispensed from the tube. More specifically, the stop mechanism is adjustable and the dispenser is fabricated from a plurality of modules.

BRIEF DESCRIPTION OF THE DRAWINGS

The character of the invention, however, may be best understood by reference to one of its structural forms, as illustrated by the accompanying drawings, in which.

DETAILED DESCRIPTION OF THE INVENTION

Figure 1:
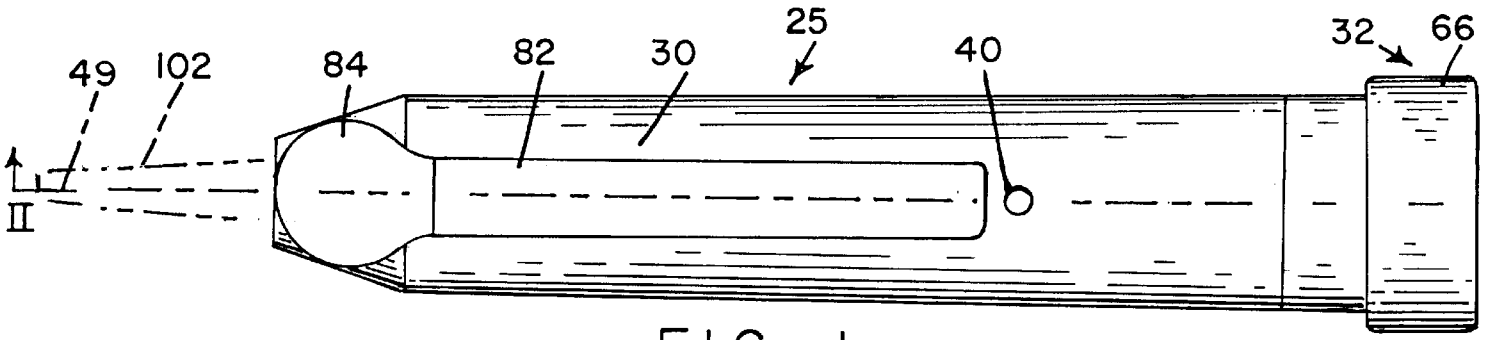
FIG. 1 is a plan view of the dispenser of the present invention.
Figure 4:
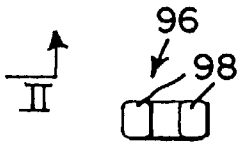
FIG. 4 is a top plan view of an adjustment lug for the dispenser.
Figure 5:
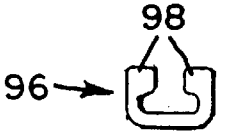
FIG. 5 is a front elevational view of the adjustment lug.
Figure 3:
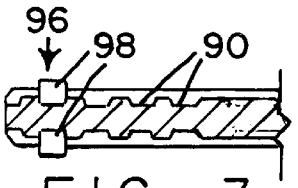
FIG. 3 is a vertical cross-sectional view taken along the line III—III of FIG. 2 and looking in the direction of the arrows.

Referring first to FIGS. 1–5, the dispenser of the present invention is generally indicated by the reference numeral 25 and is made up of a number of modular components. The dispenser 25 includes a housing, generally indicated by the reference numeral 26 which has a central longitudinal axis 49. Housing 26 comprises an outer sleeve, generally indicated by the reference numeral 27, and an inner sleeve, generally indicated by the reference numeral 28 and located within the outer sleeve. An actuating lever 30, generally indicated by the reference numeral 30, is pivotally connected to the inner sleeve 28. The dispenser 25 also includes an end cap, generally indicated by the reference numeral 32.

Figure 13:
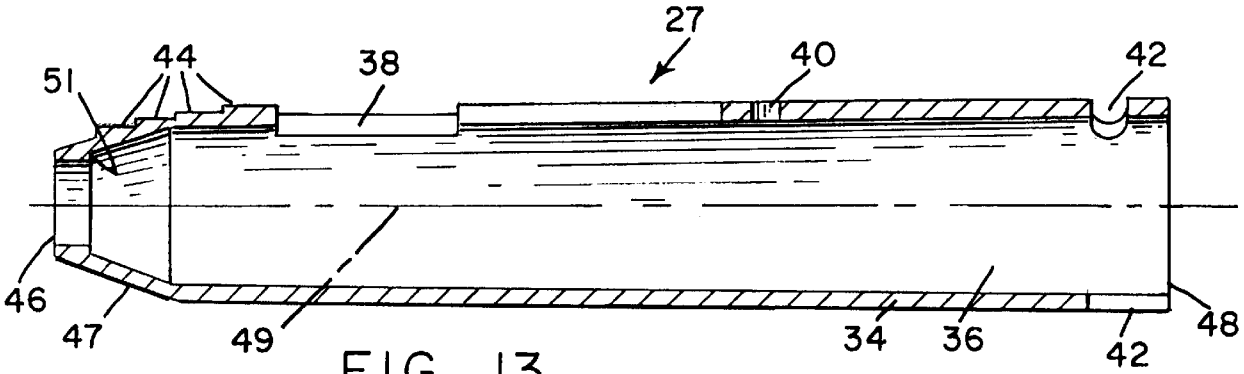
FIG. 13 is a vertical cross-sectional view of the outer sleeve taken along the line XIII—XIII of FIG. 10 and looking in the direction of the arrows.
Figure 14:
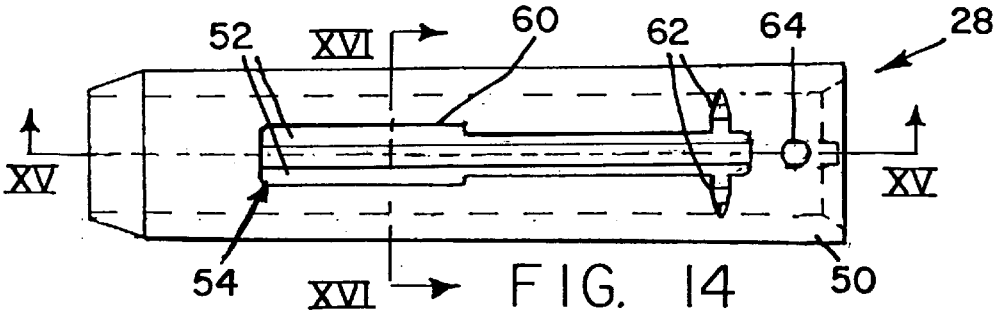
FIG. 14 is a top plan view of an inner sleeve which forms part of the dispenser.
Figure 15:
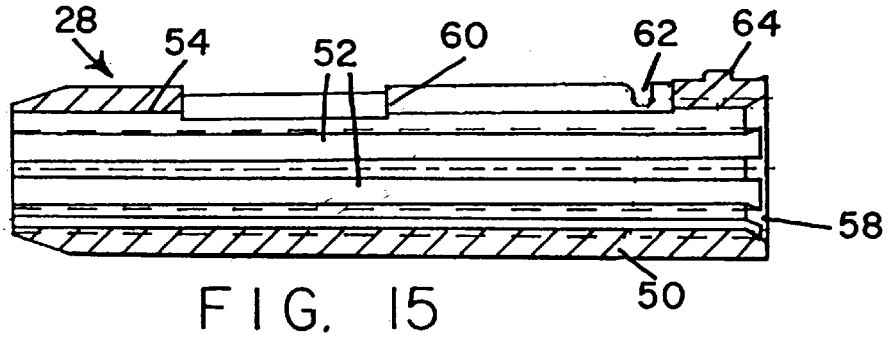
FIG. 15 is a vertical cross-sectional view of the inner sleeve, taken along the line XV—XV and looking in the direction of the arrows.
Figure 16:
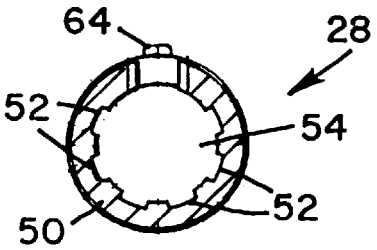
FIG. 16 is a vertical cross-sectional view of the inner sleeve, taken along the line XVI—XVI and looking in the direction of the arrows.
Figure 17:
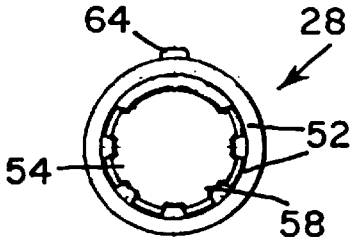
FIG. 17 is a rear elevational view of the inner sleeve, looking in the directions of arrows of XVII of FIG. 14.
Figure 18:
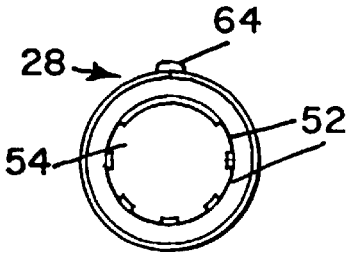
FIG. 18 is a front elevational view of the inner sleeve, looking in the direction of XVIII.
Figure 19:
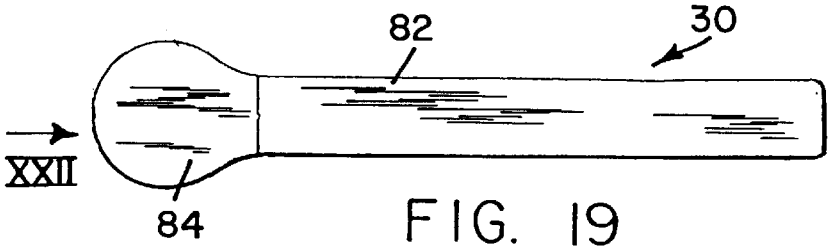
FIG. 19 is a top plan view of an actuating lever which forms part of the dispenser of the present invention.
Figure 20:
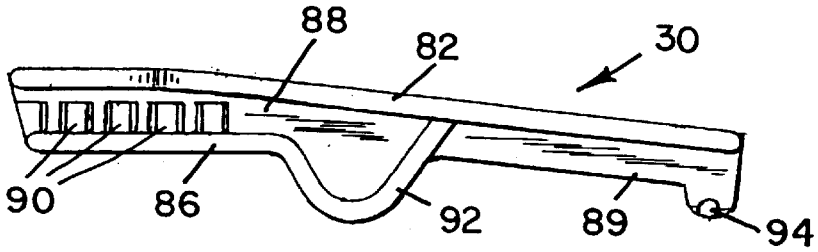
FIG. 20 is a side elevational view of the actuating lever.

Referring to FIGS. 10–13, the outer sleeve 27 comprises an outer cylindrical wall 34 which defines an outer chamber 36. The front end of the outer sleeve has an outer front opening 46 to the chamber 36 and a frusto-conical or tapered surface 47 adjacent the outer front opening 46. An internal annular shoulder 51 surrounds the outer front opening 46. The wall 34 has an outer rear opening 48, an outer side opening, or slot 38, a locating hole 40 and a pair of L-shaped rearward slots 42. The front end of the outer sleeve 27 has a plurality of stop surfaces 44 in front of the outer side slot 38. The stop surfaces 44 are stepped and spaced from the axis 49 at progressively increasing distances going from left to right as shown in FIG. 13.

Referring to FIGS. 14–18, the inner sleeve 28 comprises a cylindrical wall 50 which defines an inner chamber 54. The inner surface of the wall 50 has a plurality of elongated longitudinal grooves 52. The wall 50 has an elongated inner side slot 60. A pair of lateral notches 62 extend outwardly from the slot 60 at the rear end of the slot. A circular projection extends upwardly from the outer surface of the wall 50 at the top of the wall near the rear end of the inner sleeve 28. The inner sleeve 28 has an inner front opening 26 and an inner rear opening 58. The openings 56 and 58 are both connected to the chamber 54.

Referring to FIGS. 6–9, the end cap 32 has a circular head portion 66 and an elongated cylindrical shank portion 68 which extends horizontally from the head portion 66. The shank portion has a bore 70 and a counterbore 72. A shoulder 74 is located between the counterbore 72 and the bore 70. The head portion 66 has a pair of forwardly and inwardly extending lugs 76.

Figure 21:
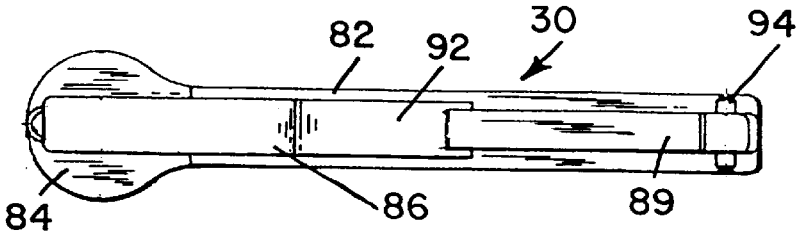
FIG. 21 is a bottom plan view of the actuating lever.
Figure 22:
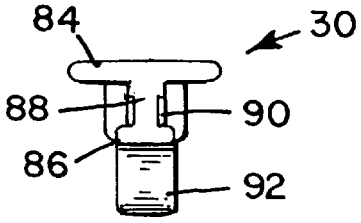
FIG. 22 is a front elevational view of the actuating lever.

Referring to FIGS. 19–22, the actuating lever 30 comprises an upper horizontal wall 82, a lower horizontal wall 86, and a vertical flange 88 which extends between the upper wall 82 and the lower wall 86. A vertical flange 89 extends downwardly from the upper wall 82 at the rear end of the lever 30. The flange 88 has a plurality of spaced vertical notches 90. The upper wall 82 is enlarged at the forward end of the actuating lever to define a finger pad 84. The lower wall 86 has a rounded downwardly facing protrusion 92. A laterally extending horizontal pivot pin 94 is mounted in the flange 89 at the rear end of the actuating lever 30 so that it extends from both sides of the flange 89, as shown in FIG. 21.

Figure 2:
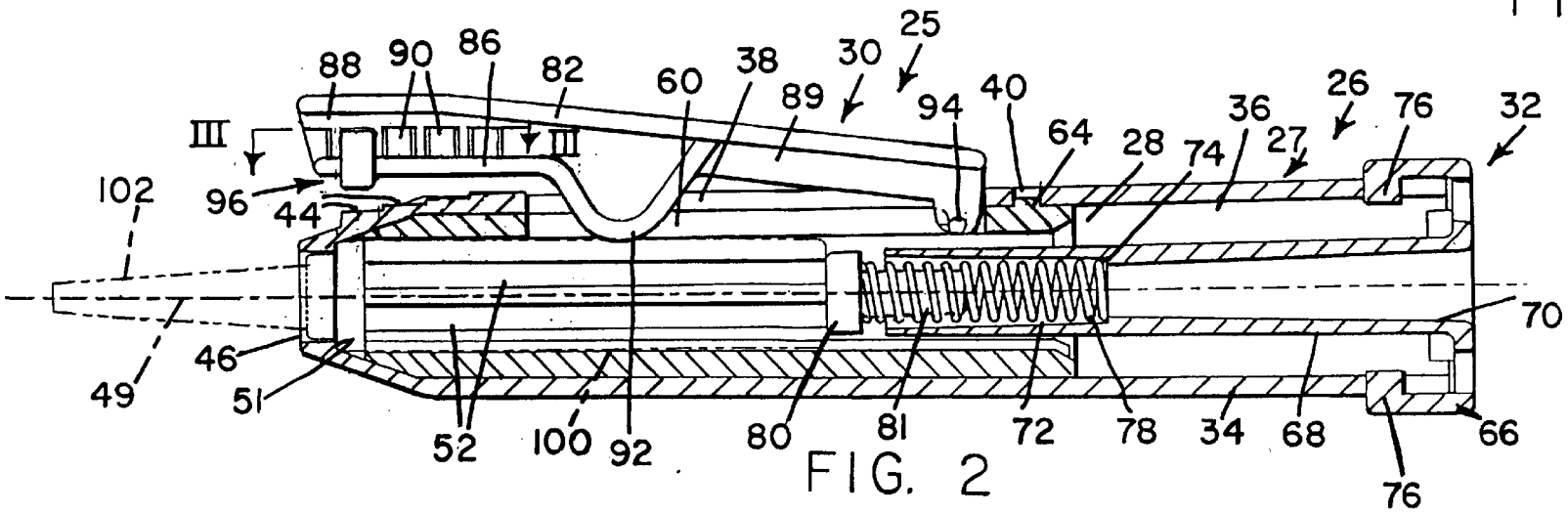
FIG. 2 is a vertical cross-sectional view of the dispenser taken along the line II—II of FIG. 1.
Figure 6:
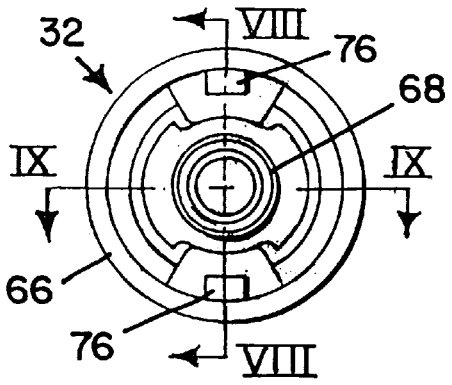
FIG. 6 is a front elevational view of an end cap for the dispenser.
Figure 7:
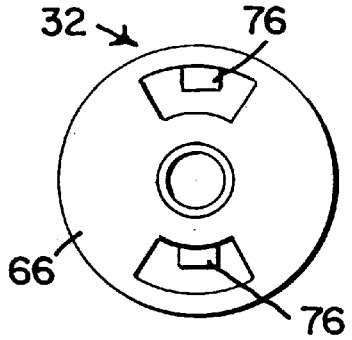
FIG. 7 is a rear elevational view of the end cap.
Figure 8:
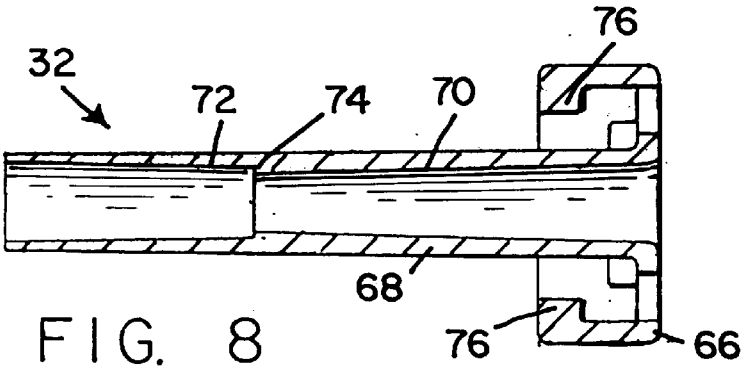
FIG. 8 is a vertical cross-sectional view of the end cap, taken along the line VIII—VIII of FIG. 6 and looking in the direction of the arrows.
Figure 9:
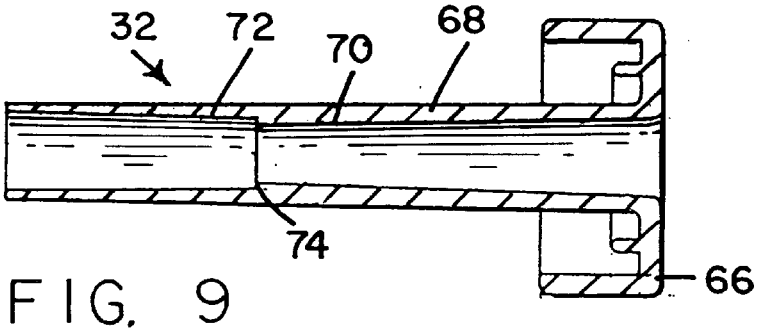
FIG. 9 is a horizontal cross-sectional view of the end cap, taken along the line IX—IX of FIG. 6 and looking in the direction of the arrows.
Figure 11:
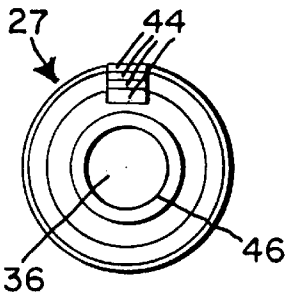
FIG. 11 is a front elevational view of the outer sleeve.
Figure 12:
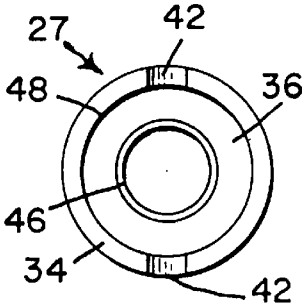
FIG. 12 is a rear elevational view of the outer sleeve.
Figure 10:
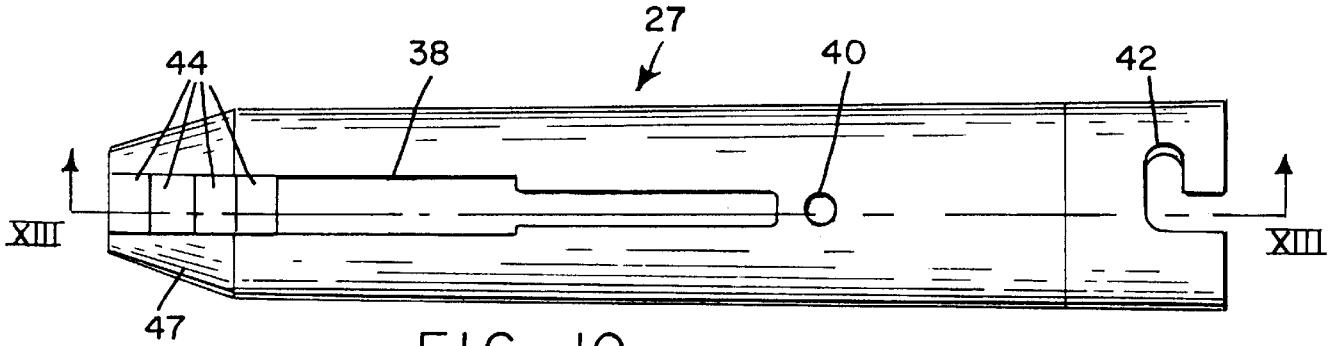
FIG. 10 is a top plan view of an outer sleeve which forms part of the dispenser.

The dispenser 25 is assembled by inserting the inner sleeve 28 into the outer chamber 36 of the outer sleeve 27 so that the forward end of the inner sleeve rests against the tapered surface 47 at the front end of the outer sleeve. The actuating lever 30 is positioned on the housing 26 so that the rounded protrusion 92 extends through the outer side slot 38 of the outer sleeve 27 and the inner side slot 60 of the inner sleeve 28 and the pivot pin 94 is pressed into the lateral notches 62 so that the actuating lever 30 is pivotally connected to the inner sleeve, as shown in FIG. 2. A U-shaped adjustment lug, generally indicated by the reference numeral 96, is applied to the lower wall 86. The adjustment lug 96 has a pair of opposed inwardly facing fingers 98 which fit into a pair of opposed notches 90. The adjustment lug 96 is made up of a yieldable resilient material such as plastic which enables the lug to move in and out of engagement with any one of the notches 90. The adjustment lug 96 is vertically aligned with the stop surfaces 44 for limiting the downward pivoting movement of the actuating lever, depending which on which of the stop surfaces 44 that the adjustment lug is aligned with. A compression spring 78 is placed within the counterbore 72 and the shank portion 81 of a plunger 80 is inserted within the compression spring 78. A compressible tube 100 containing liquid material to be dispensed is inserted within the inner chamber 54 of the inner sleeve 28 so that the forward end of the tube abuts the shoulder 51 and the applicator nozzle 102 of the tube extends through the outer forward opening 46 of the outer sleeve 27. The spring 78, acting through the push rod 80, biases the tube 100 against the shoulder 67, end cap 32 is inserted into the rear opening 48 of the outer sleeve 27. The forwardly extending lugs 76 are inserted into the slots 42 and the end cap 32 is given a quarter turn so that the lugs 76 enter the lateral portions of the slots 42 to constitute a "bayonet" type connection. The head portion of the plunger 80 bears against the rear end of the tube 100 under the bias of the compression spring 78 to maintain the tube 100 positioned at the forward end of the housing 26. The downwardly extended rounded protrusion 92 engages the upper end of the tube 100. This arrangement also enables tubes of various lengths to be used within the dispenser 25. By being able to adjust the position of the adjustment lug 96 relative to the notches 90 to control the movement of the actuating lever 30, the operator is able to control the amount of liquid to be released from the tube 100 each time that the actuating lever is depressed. The longitudinal notches 52 of the inner sleeve define elongated runners which make limited contact with the material tube 100 so that the tube engages the inner surface of the wall 50 of the tube at spaced contact points. This limited area of contact is such that when pressure is placed on top of the material tube by the actuating lever 30, the lever essentially squeezes the tube and gives it a pinching action. When the inner sleeve 28 is inserted within the outer sleeve 27, the circular projection or dog 64 snaps into the locating hole 40 to position and lock the inner sleeve within the outer sleeve. The inner and outer sleeves are made of a yieldable resilient material such as plastic for ease of modular assembly and durability. The actuating lever 30 is preferably made of a glass reinforced plastic material to enable the actuating lever to withstand the stress of repeated actuations.

What is claimed is:

1. A liquid dispenser comprising:

(a) a housing having a chamber for containing a compressible tube containing a liquid to be dispensed, said tube having a rear end and a frond end which includes a dispensing nozzle, said housing having a front end, a rear end, a front opening to the chamber at said front end for the dispensing nozzle of said tube, and a side opening to the chamber, said housing having a central longitudinal axis;

(b) an actuating lever pivotally connected to the housing for movement toward and away from said central longitudinal axis and said side opening, said actuating lever having a protrusion which extends through said side opening for engaging said tube and a handle portion located outside said housing for pressing engagement by an operator for causing said actuating lever to move toward said tube and causing said protrusion to compress said tube to force liquid from said tube through end of said tube through the dispensing nozzle; and (c) stop means for limiting the movement of said actuating lever toward said tube.

2. A liquid dispenser as recited in claim 1, wherein said stop means is adjustable for selectively controlling the amount of movement of said actuating lever toward said tube to control the amount of liquid which is dispensed from said tube.

3. A liquid dispenser as recited in claim 1, wherein said stop means comprises:

(a) a stop surface on said housing; and (b) an adjustment lug slidably mounted on said actuating lever for selectively occupying one of a plurality of positions, the distance between said stop surface and said lug being different for each of said plurality of positions so that the angular movement of said actuating lever is different for each position of said lug relative to said actuation lever.

4. A liquid dispenser as recited in claim 3, wherein said lug is slidably mounted on said actuating lever along a sliding axis which is substantially parallel to said central longitudinal axis and said stop surface has a plurality of steps representing said plurality of positions of said lug.

5. A liquid dispenser as recited in claim 1, wherein said housing has a tube stop adjacent said front opening and said dispenser further comprises biasing means within said chamber for biasing said tube toward said front opening against said tube stop.

6. A liquid dispenser as recited in claim 5, wherein said biasing means comprises:

(a) a plunger mounted within said chamber for abutting said tube and for movement along said central longitudinal axis relative to said housing; and (b) a compression spring for biasing said plunger toward said front opening.

7. A liquid dispenser as recited in claim 1, wherein said housing has a modular construction comprising:

(a) an outer sleeve having an outer chamber with an outer front opening to the outer chamber and defining at least in-part, said front opening, an outer rear opening to the outer chamber and an outer side opening to the outer chamber and defining at least in-part, said side opening;

(b) sleeve located within said outer chamber and having an inner chamber for holding said tube, an inner front opening to said chamber adjacent and aligned with said outer front opening and defining at least in-part, said front opening, an inner rear opening to said chamber aligned with said outer rear opening for enabling said tube to be inserted through said inner and outer rear openings into said chamber and an inner side opening defining at least in-part, said side opening to said chamber adjacent and aligned with said outer side opening so that said protrusion extends through said outer and inner side openings and into said chamber and, (c) an end cap removably mounted on said outer housing for closing said outer rear opening.

8. A liquid dispenser as recited in claim 7, wherein said dispenser further comprises locating means for enabling said inner sleeve to be positioned relative to said outer sleeve so that said outer side opening is aligned with said inner side opening and is maintained aligned with said inner side opening.

9. A liquid dispenser as recited in claim 8, wherein said locating means comprises a projection on one of said inner and outer sleeves and an aperture in the other of said inner and outer sleeves for receiving said projection.

10. A liquid dispenser as recited in claim 7, wherein said housing has a tube stop adjacent said front opening and said dispenser further comprises biasing means within said chamber for biasing said tube toward said front opening against said tube stop.

11. A liquid dispenser as recited in claim 10, wherein said biasing means comprises:

(a) a plunger mounted within said chamber for abutting said tube and for movement along said central longitudinal axis relative to said housing; and (b) a compression spring for biasing said plunger toward said front opening.

12. A liquid dispenser as recited in claim 11 wherein said end cap has a head portion which closes said outer rear opening and a tubular shank portion extending into said chamber through said inner rear opening, said tubular shank portion having a bore and an end opening to the bore, and wherein said plunger has a head portion for engaging the rear end of said tube and a shank portion for extending into said bore, said compression being located within said bore.

* * * * *